US011105037B2

(12) United States Patent
Bringewatt et al.

(10) Patent No.: US 11,105,037 B2
(45) Date of Patent: Aug. 31, 2021

(54) DEVICE FOR MANGLING LAUNDRY ITEMS

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 664 days.

(21) Appl. No.: 16/067,936

(22) PCT Filed: Nov. 9, 2016

(86) PCT No.: PCT/EP2016/001849

§ 371 (c)(1),
(2) Date: Jul. 3, 2018

(87) PCT Pub. No.: WO2017/121439

PCT Pub. Date: Jul. 20, 2017

(65) Prior Publication Data

US 2021/0017693 A1 Jan. 21, 2021

(30) Foreign Application Priority Data

Jan. 14, 2016 (DE) ..... 102016000226.3

(51) Int. Cl.
*D06F 45/12* (2006.01)

(52) U.S. Cl.
CPC ..... *D06F 45/12* (2013.01)

(58) Field of Classification Search
CPC ..... D06F 45/12; D06F 45/00; D06F 58/00; D06F 58/22

(Continued)

(56) References Cited

U.S. PATENT DOCUMENTS 4,414,765 A * 11/1983 Kreinberg ..... D06F 67/00 38/54
4,621,438 A * 11/1986 Lanciaux ..... D06F 58/30 34/77

(Continued)

FOREIGN PATENT DOCUMENTS

DE 102016000226 A1 * 7/2017 ..... D06F 69/02
DE 102018213108 A1 * 2/2020 ..... D06F 58/20

(Continued)

OTHER PUBLICATIONS

WIPO, International Search Report (on parent application), dated Dec. 12, 2016.

*Primary Examiner* — Stephen M Gravini
(74) *Attorney, Agent, or Firm* — Laurence P. Colton; Smith Tempel Blaha LLC

(57) ABSTRACT

Providing a boiler in the interior of the mangle body, for heating up a gas in particular by an infrared radiant heater, which heats up a heat transfer medium in the cavity of a double-walled shell of the mangle body. The pressing surface of the mangle body can be heated up effectively and in a targeted manner by this heat transfer medium in the cavity of the double-walled shell of the mangle. Belt mangles are known, in the case of which a circumferentially driven mangling belt runs along the outside of the stationary mangle body, which mangling belt transports the laundry items to be mangled on the smooth pressing surface of the mangle body by entrainment. The heating of the pressing surface has been shown to be ineffective in the case of these known belt mangles.

20 Claims, 5 Drawing Sheets

(58) Field of Classification Search
USPC ..... 34/595–610; 134/84
See application file for complete search history.

(56) References Cited

U.S. PATENT DOCUMENTS

| | | | | | |
|---|---|---|---|---|---|
| 4,700,492 | A * | 10/1987 | Werner | D06F 58/22 | 34/403 |
| 5,724,750 | A * | 3/1998 | Burress | D06F 58/206 | 34/267 |
| 6,212,792 | B1 * | 4/2001 | Bier | D06F 58/04 | 34/315 |
| 7,020,985 | B2 * | 4/2006 | Casey | D06F 58/02 | 34/595 |
| 7,441,345 | B2 * | 10/2008 | Taylor | D06F 58/203 | 34/406 |
| 7,658,015 | B1 * | 2/2010 | Gardell | D06F 58/20 | 34/90 |
| 8,919,009 | B2 * | 12/2014 | Colombo | D06F 58/203 | 34/413 |
| 9,127,400 | B2 * | 9/2015 | Herman | D06F 58/26 | |
| 9,359,716 | B2 * | 6/2016 | Bringewatt | D06F 63/00 | |
| 10,246,813 | B2 * | 4/2019 | Herman | D06F 58/04 | |
| 10,480,116 | B2 * | 11/2019 | Benedetto | D06F 58/203 | |
| 10,900,161 | B2 * | 1/2021 | Park | D06F 39/085 | |
| 2020/0024794 | A1 * | 1/2020 | Pattarello | D06F 58/34 | |
| 2020/0040515 | A1 * | 2/2020 | Bellm | D06F 58/30 | |
| 2020/0056315 | A1 * | 2/2020 | Bringewatt | F26B 3/30 | |
| 2020/0208321 | A1 * | 7/2020 | Hong | D06F 27/00 | |
| 2021/0017693 | A1 * | 1/2021 | Bringewatt | D06F 67/02 | |
| 2021/0095417 | A1 * | 4/2021 | Vaive | D06F 58/30 | |
| 2021/0102324 | A1 * | 4/2021 | Park | D06F 25/00 | |

FOREIGN PATENT DOCUMENTS

| | | | | | |
|---|---|---|---|---|---|
| EP | 2857577 | A1 | 4/2015 | | |
| EP | 3051018 | A2 | 8/2016 | | |
| EP | 3597815 | A1 * | 1/2020 | D06F 58/30 | |
| EP | 3608469 | A3 * | 5/2020 | D06F 58/30 | |
| WO | WO-2017121439 | A1 * | 7/2017 | D06F 69/02 | |

* cited by examiner

DEVICE FOR MANGLING LAUNDRY ITEMS

CROSS-REFERENCE TO RELATED APPLICATIONS

This application is the US National Phase of and claims the benefit of and priority on International Application No. PCT/EP2016/001849 having a filing date of 9 Nov. 2016, which claims priority on and the benefit of German Patent Application No. 10 2016 000 226.3 having a filing date of 14 Jan. 2016.

BACKGROUND OF THE INVENTION

Technical Field

The invention relates to a device for mangling laundry items at least one stationary mangle body, the outer shell surface of which forms a heatable pressing surface and at least one circumferentially drivable mangling belt assigned to the at least one mangle body, by which mangling belt the laundry items can be moved along on the outer pressing surface of the at least one mangle body.

Prior Art

Mangling of laundry items of all types is performed in particular in commercial laundries with various devices. These involve trough-style mangles or belt mangles.

The invention relates to belt mangles. In the case of known devices of this type, the laundry items to be mangled are moved by the circumferentially driven mangling belt along the idle mangle body. The laundry items are transported by the mangling belt along the outer shell surface of the mangle body which serves as a pressing surface. It is not only belt mangles with a single mangle body which are known, rather also those with several consecutive mangle bodies, wherein either a separate mangling belt is assigned to each mangle body or a joint mangling belt is assigned to all the mangle bodies.

It must be possible for heat to act upon the laundry items to be mangled from the pressing surface of the respective mangle body. To this end, it must be possible to heat the pressing surface of the respective mangle body. In the case of known belt mangles, this is performed from the inside by, for example, steam which is generated centrally or also adjacent to the device. This requires additional space and lines for the supply of steam or the like to the respective mangle body. The external generation of the energy required to heat the pressing surface of the respective mangle body has furthermore been shown to be ineffective.

BRIEF SUMMARY OF THE INVENTION

The object on which the invention is based is to create a device for mangling laundry items which ensures simple and effective heating of the pressing surface of the at least one ironing body.

A device to achieve this object is a device for mangling laundry items with at least one stationary mangle body, the outer shell surface of which forms a heatable pressing surface and at least one circumferentially drivable mangling belt assigned to the at least one mangle body, by which mangling belt the laundry items can be moved along on the outer pressing surface of the at least one mangle body, characterized in that the at least one mangle body is formed to be double-walled with at least one cavity between the walls, a heat transfer medium is located in the at least one cavity and/or at least one heating device for heating the heat transfer medium in the cavity is arranged entirely or at least partially in the interior of the at least one mangle body. It is provided in the case of this device to form the respective, preferably stationary mangle body to be double-walled with at least one cavity for a heat transfer medium and/or arrange at least one heating device for heating the heat transfer medium entirely or at least partially in the interior of the at least one preferably stationary mangle body. The pressing surface can be effectively heated up by the heat transfer medium of the at least one double-walled ironing body. In particular, a targeted heating up of the pressing surface is possible by the heat transfer medium in at least one double-walled ironing body. The heat transfer medium in the double-walled shell surface of the respective mangle body can be efficiently heated up by the heating device arranged at least partially in the interior of the or each mangle body.

A further device to achieve the above-mentioned object is a device for mangling laundry items with at least one stationary mangle body, the outer shell surface of which forms a heatable pressing surface and at least one circumferentially drivable mangling belt assigned to the at least one mangle body, by which mangling belt the laundry items can be moved along on the outer pressing surface of the at least one mangle body, characterized in that the interior of the at least one mangle body is formed as at least one boiler. This can involve an independent solution to the object, but also a preferred further development of the device. It is provided in the case of the further device to form the interior of the at least one preferably stationary mangle body as at least one boiler. The interior of the at least one mangle body is closed for this purpose. The interior of the at least one mangle body is preferably closed to be gas- or pressure-tight and/or pressure-resistant. As a result, the energy required to heat the pressing surface thereof is provided and/or generated in the heating body-like interior of the respective ironing body.

It is conceivable to form a device as disclosed herein and the at least one mangle body as disclosed herein also to be double-walled and arrange a preferably liquid heat transfer medium in the double-walled shell of the stationary mangle body. Alternatively or additionally, in the case of the further device, it can be provided to provide at least one heating device for heating up the heat transfer medium in the respective double-walled mangle body entirely or partially in the interior of the at least one mangle body. This heating device can be arranged entirely or partially in the heating body in the at least one mangle body and/or in the interior thereof. A particularly compact and energy-efficient device is created by the stated configurations.

Advantageous possibilities for further development of the two devices described herein are explained in greater detail below:

One possibility for the further development of the devices provides providing at least one heating body which forms at least a part of the heating device in the interior of the at least one mangle body. The at least one heating body can be arranged in the interior of the boiler and/or in the part of the interior of the at least one mangle body which is formed to be gas- and/or pressure-resistant. The heating body is preferably a radiant heater. Such a radiant heater can be formed to generate infrared radiation (IR radiation) which heats up the interior of the at least one mangle body, in particular the interior of the heating body arranged therein, by radiation. Gas enclosed in the interior of the respective mangle body, in particular of the heating body, is preferably heated up by the at least one heating body, preferably the at least one radiant heater, and indeed preferably by heat radiation. The possibilities described for generating heat energy in the at least one mangle body are very effective and efficient.

It is furthermore conceivable to arrange at least one burner which forms the heating device or a part thereof in the outlines of the at least one mangle body. In the case of a device provided with a boiler, the at least one burner is arranged preferably externally on the boiler, wherein the burner introduces the energy generated by it directly into the boiler. In this case, the at least one burner and the boiler are arranged in the outlines or in the interior of the respective mangle body. This leads to a particularly compact design of the device, in the case of which the heating device is formed in particular from at least one burner and at least one heating body, preferably a radiant heater such as, for example, an infrared radiant heater.

Another advantageous configuration possibility of the device provides providing a boiler area of the boiler and/or of the interior, which is formed in a gas- and/or pressure-tight manner, of the at least one ironing body with separate heating chambers. As a result, the individual heating chambers can be heated individually. It is particularly advantageous if the at least one heating body or radiant heater is arranged only in a single heating chamber, preferably only a first heating chamber. The gas, preferably air, heated by this heating body or radiant heater then serves to consecutively heat up several or all subsequent heating chambers. Individual heating of the entire pressing surface of the or each ironing body of the belt mangles which corresponds to requirements can thus be performed.

The several heating chambers in the respective ironing body are preferably formed and/or separated from one another by at least one air-tight and/or pressure-tight separating wall in the boiler or in the interior of the at least one mangle body. The single heating chambers in the ironing body or the interior of the same formed boiler can be easily formed in this manner.

It is furthermore conceivable to connect the individual consecutive heating chambers in the shell space of the respective ironing body to one another by way of overflow openings or overflow ducts. It is then possible that the air heated up in the first or single heating chamber by the at least one heating body or a different gaseous medium, including flue gas from the burner, flows through and gradually heats the heating chamber, preferably in stages.

It is preferably provided to assign a discharge line for, for example, gas, including flue gas, to the single heating chamber or—in the case of several consecutive heating chambers—the last heating chamber. The discharge line is preferably one for cooled gas, including flue gas, from the interior of the respective mangle body, in particular the boiler.

A separating web or a separating bar is preferably provided in the cavity of the double-walled shell of the at least one mangle body. The separating web or the separating bar form a gas- and pressure-tight partition in the cavity, as a result of which it does not revolve uninterrupted in the double-walled shell. As a result of this, the separating web or the separating bar delimit a start and an end of the cavity.

The at least one cavity in the double-walled shell of the at least one mangle body is preferably provided with at least one guiding web, in particular several guiding webs. The guiding web or the guiding webs is/are formed so that they create, in the interior of the cavity, at least one wavy line-like flow duct for the heat transfer medium in the double-walled shell of the at least one mangle body. As a result of this, the heat transfer medium, which is heated up by the thermal energy generated in the interior of the respective mangle body, in particular in the boiler, in the double-walled shell at least of an ironing body can flow in a changing direction in a wavy line-like or meandering manner through the double-walled shell of the respective mangle body. At least one circulating pump can be provided for circulation of the liquid heat exchanger or heat transfer medium by the at least one flow duct of the double-walled shell of the respective mangle body. Circulation can, however, also be performed automatically as a result of gravity and/or thermally due to cooling of the heat transfer medium on the pressing surface and heating up on the inner shell surface of the double-walled shell of the respective mangle body.

In particular if several heating chambers are provided in the interior of the boiler area of the boiler, it can be advantageous to form several separate cavities in the double-walled shell of the at least one mangle body. A cavity in the double-walled shell is then preferably assigned to the heating chamber. A liquid heat transfer medium in the respective cavity of the double-walled shell can be heated in a targeted manner by the respective heating chamber.

The heat transfer medium in the double-walled shell is preferably a flowable medium, in particular a flowable heat transfer medium, such as a thermal oil or a different heat transfer fluid which permits a high energy density.

BRIEF DESCRIPTION OF THE DRAWINGS

Preferred exemplary embodiments of the invention are explained in greater detail below on the basis of the drawing. In this drawing.

DETAILED DESCRIPTION OF PREFERRED EMBODIMENTS

Figure 1:
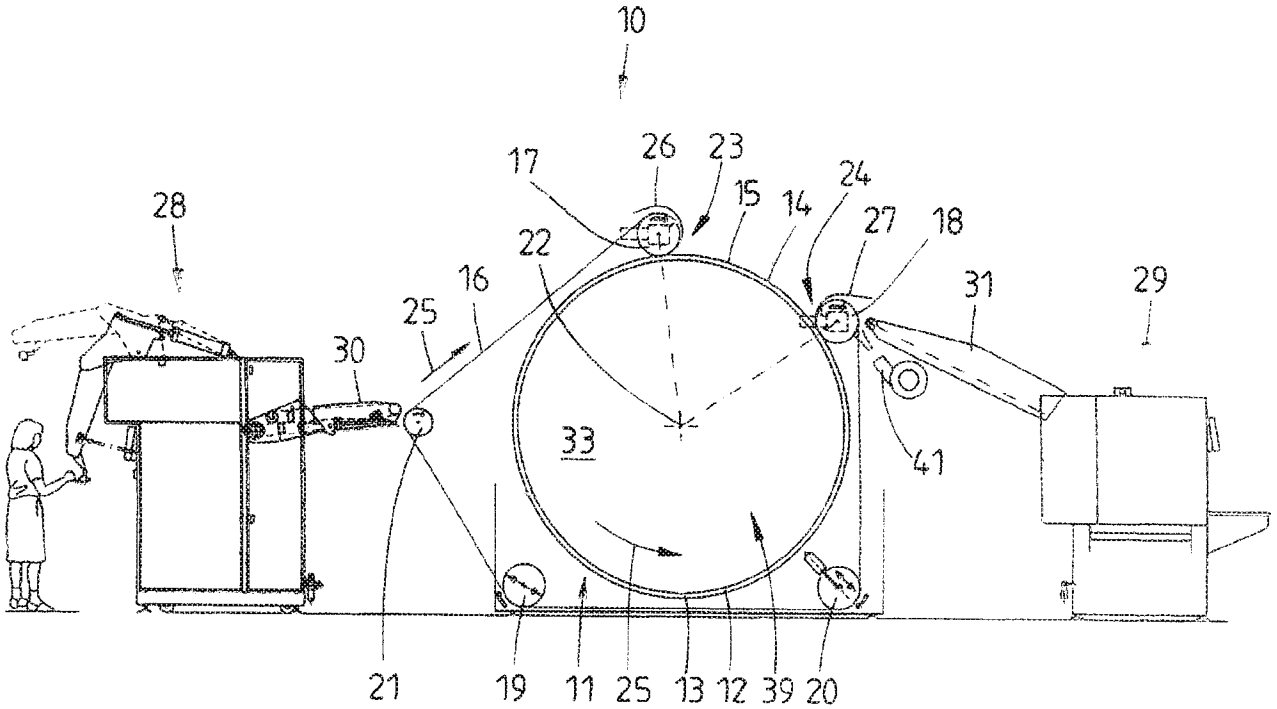
FIG. 1 shows a schematic side view of a device.

The figures show a device formed as belt mangle 10 for smoothing out laundry items. The laundry items are not shown in the figures. The laundry items can be any desired laundry items, and indeed both flat linen and garments.

Shown belt mangle 10 has a single closed or drum-like mangle body 11. Mangle body 11 represented in the figures is formed to be cylindrical. Non-round mangle bodies are, however, also conceivable. Mangle body 11 cannot be driven rotationally, is therefore continuously stationary.

An outer side of mangle body 11 forms a continuous, stationary cylindrical pressing surface 12. The laundry items to be mangled or ironed are moved in a sliding manner along pressing surface 12. Pressing surface 12 is, for this purpose, formed to be smooth in that the steel, in particular stainless steel, from which mangle body 11 is normally formed, is polished.

Fixed, stationary mangle body 11 is formed to be fully double-walled by an outer cylindrical mangle body wall 13 and an inner mangle body wall 14, which has a smaller diameter and is arranged concentrically in relation thereto. As a result of this, a ring-like cavity 15 in mangle body 11 is generated between mangle walls 13 and 14. A liquid heat transfer medium, for example, a thermal oil, is located in cavity 15. The heat transfer medium preferably circulates in cavity 15 in that it is pumped, for example, through a pump arranged outside cavity 15 or the like from one end of cavity 15 into another end thereof, and indeed preferably in the same direction in which the laundry items slide along pressing surface 12 during mangling. This can be carried out continuously so that the heat transfer medium or thermal oil flows continuously through cavity 15 and as a result is permanently circulated therein. Pressing surface 12 is located on the outer side of outer mangle body wall 13. The heat transfer medium or thermal oil in cavity 15 of double-walled mangle body 11 is heated by the inner side of inner mangle body wall 14, and indeed in such a manner that it always has a provided setpoint temperature or lies in a setpoint temperature range.

A single circumferentially drivable and continuous mangling belt 16 is assigned to cylindrical mangle body 11 of belt mangle 10 on the outside. Mangling band 16 is guided around a majority of the outer circumference, namely pressing surface 12, of cylindrical mangle body 11, and indeed by 250° to 340°, preferably approximately 300° to 340°. As a result, a large pressing surface 12 of mangle body 11 is generated.

Continuous mangling belt 16 which is continuous over the entire width of mangle body 11 is deflected around five deflection drums 17-21 in the exemplary embodiment shown. The rotational axes of deflection drums 17-21 run parallel to a horizontal longitudinal center axis 22 of stationary mangle body 11. A deflection drum 17 arranged above the uppermost point of cylindrical mangle body 11 forms a run-in region 23 of belt mangle 10. An adjacent deflection drum 18 forms a run-out region 24 of belt mangle 10. Both deflection drums 17 and 18 are preferably rotationally drivable, and indeed with a rotational speed which is defined by a control, not shown, and is individually adjustable. Deflection drums 17, 18 are preferably always driven with the same rotational speed. It is conceivable to drive deflection drum 18 in run-out region 24 slightly faster so that mangling belt 16 is pushed tighter on pressing surface 12. Deflection drums 17 and 18 are driven in such a direction that mangling band 16 runs along pressing surface 12 with a direction of transport 25 in the anti-clockwise direction from run-in region 23 to run-out region 24. Deflection drums 19 and 20 are arranged on both sides below mangle body 11. These are freely rotatable, wherein at least one of deflection drums 18 and/or 19 can be adjustable in order to change the tensioning of continuous mangling belt 16. Fifth non-driven deflection drum 21 is arranged laterally next to mangle body 11, and indeed so that it deflects mangling belt 16 laterally from mangle body 11.

Mangling belt 16 is provided at least on the side facing pressing surface 12 with an elevated or higher frictional coefficient for entrainment of the laundry items and transporting them along on the smooth, stationary pressing surface 12. For this purpose, for example, the surface of mangling belt 16 can be roughened or abraded.

If no laundry item is located between mangling belt 16 and pressing surface 12, mangling belt 16 bears against pressing surface 12. If a laundry item is transported by mangling belt 16 along stationary pressing surface 12, mangling belt 16 is spaced apart from pressing surface 12 by the thickness of the laundry item for formation of a mangling gap for the respective laundry items between mangling belt 16 and pressing surface 12. This mangling gap is not represented in the figures because these do not show any laundry item between mangling belt 16 and pressing surface 12.

A flexible sheet which has smooth surfaces or a flexible, film-like material strip, for example, a TEFLON® material web, is assigned at least to run-in region 23, in the exemplary embodiment shown, also run-out region 24. In run-in region 23, this serves as a run-in aid and in run-out region 24 as a run-out aid. In run-in region 23, the laundry items are guided, lying on the portion of mangling belt 16 running back between deflection drums 17 and 21, between run-in aid 26 and mangling belt 16 around deflection drum 17 into the mangling gap at run-in region 23 of belt mangle 10. Run-in aid 26, which is assigned fixedly to deflection drum 17, ends shortly behind deflection drum 17. As a result, after leaving run-in aid 26, the respective laundry item arrives between pressing surface 12 of mangle body 11 and the side of mangling belt 16 pointing towards this. Vice versa, run-out aid 27 conducts the mangled laundry item away from the pressing surface in order to discharge the mangled laundry item between run-out aid 27 and mangling belt 16 about an upper region of deflection drum 18 out of run-out region 24. In the exemplary embodiment of FIG. 1, a blower 41 or alternatively compressed air nozzles in order to support the discharge of the respective mangled laundry item from deflection drum 18 is/are also assigned to deflection drum 18 in run-out region 24. Additionally or alternatively to run-out aid 27, a brush roller, not shown, for removing the mangled laundry item from pressing surface 12 can be assigned in run-out region 24.

In the exemplary embodiment of FIG. 1, belt mangle 10 is positioned between an input machine 28 and a folding machine 29. Input machine 28 serves to supply laundry items to be mangled to belt mangle 10. The respective laundry item is spread out by input machine 28 and placed on a supply conveyor 30 which, in the case of a single-lane mode of operation, supplies in each case an individual, spread-out laundry item in a longitudinal or transverse direction to mangling belt 16 of belt mangle 10. In the case of a multi-lane mode of operation of input machine 28, several (smaller) laundry items lying next to one another can be transported simultaneously from supply conveyor 30 in a longitudinal or transverse direction to mangling belt 16. The respective spread-out laundry item is placed by supply conveyor 30 in the region of deflection drum 21 on the strand of mangling belt 16 running back between deflection drum 21 and deflection drum 17 at run-in region 23 and transported from mangling belt 16 to run-in region 23 and indeed so that it is supplied between run-in aid 26 and mangling belt 16 in run-in region 23 to the mangling gap of belt mangle 10. Folding machine 29 follows on from run-out region 24 of belt mangle 10. The respectively mangled, smooth laundry item arrives from run-out region 24 via a run-in conveyor 31 at the folding region of folding machine 29.

Belt mangle 10 does not necessarily have to be arranged between an input machine 28 and a folding machine 29. It is conceivable that no folding machine 29 follows on behind belt mangle 10. It is also conceivable to supply laundry items to be mangled to belt mangle 10 in a different manner than by means of an input machine 28.

Double-walled mangle body 11 is formed in a particular manner and/or preferably liquid or flowable heat transfer medium in cavity 15 of double-walled mangle body 11 can be heated.

A heating body 32 is provided in the space surrounding inner mangle body wall 14. The space surrounding inner mangle body wall 14 of mangle body 11 is preferably formed at least partially as boiler 32. In the exemplary embodiment shown, the entire inner space is formed as boiler 32 in that opposite cylindrical end sides of mangle body 11 are sealed off by end walls 33 and 34. End walls 33 and 34 form, together with inner mangle body wall 14, gas-tight and pressure-resistant boiler 32 in the space surrounding the double-walled shell in the interior of mangle body 11.

An inner space 35 of boiler 32 in mangle body 11 is heatable. A heating device serves this purpose, which heating device is formed, in the case of the exemplary embodiments of FIGS. 2 to 5, from at least one burner 36 operated with fossil fuel, for example, gas or oil, and a heating body 37. However, the heating device can also possibly only have at least one burner 36.

Burner 36 is arranged outside boiler 32 in that it is fastened on the outside to an end wall 33 of mangle body 11. Heating body 37 is located in boiler 32. In the exemplary embodiment of FIGS. 2 and 3, cylindrical or tube-like heating body 37 is located on longitudinal center axis 22 of mangle body 11. The length of heating body 37 is of such dimensions that it ends with a distance in front of end wall 34, which is opposite burner 36, of boiler 32 in mangle body 11. Heating body 37 shown here is formed as a radiant heater, and indeed preferably infrared radiant heater. To this end, tube-like heating body 37 has a longitudinal cylindrical incandescent mantle 38 with a grid- or net-like and thus air-permeable shell surface. The thermal energy of the flame introduced by burner 36 into the cylindrical inner space of heating body 37 or of the flue gas causes the grid- or net-like shell surface of incandescent mantle 38 to glow, as a result of which the cylindrical shell surface of heating body 37 emits infrared radiation outward and thereby heats up inner space 35 of boiler 32, in particular the air in inner space 35 of air-tight and pressure-resistant boiler 32.

The thermal energy of the hot air generated in boiler 32 of the inner space of mangle body 11 is transferred from the inner side of inner mangle body wall 14 by heat conduction to the outer side of inner mangle body wall 14 and as a result heats or heats up the liquid heat transfer medium, in particular thermal oil, in cavity 15 of double-walled mangle body 11. The thermal oil which circulates in cavity 15 of double-walled mangle body 11 or another heat transfer medium discharges its thermal energy to outer mangle body wall 13 and as a result heats outer pressing surface 12 of mangle body 11. Pressing surface 12 is continuously heated up as a result of the circulation of the heat transfer medium in cavity 15 of double-walled mangle body 11.

The gas injected by burner 36 into boiler 32, this gas being at least largely flue gas, is discharged out of boiler 32 after cooling, which occurs during heating up of heating body 37, through a discharge opening 39, which is assigned to end wall 34 of mangle body 11 that is located opposite end wall 33 with burner 36. In the exemplary embodiment shown, this is performed by a chimney 40 assigned to discharge opening 39. The waste air or the flue gas from boiler 32 can, however, also be supplied via discharge opening 39 to a heat exchanger or discharged in a different manner.

Figure 2:
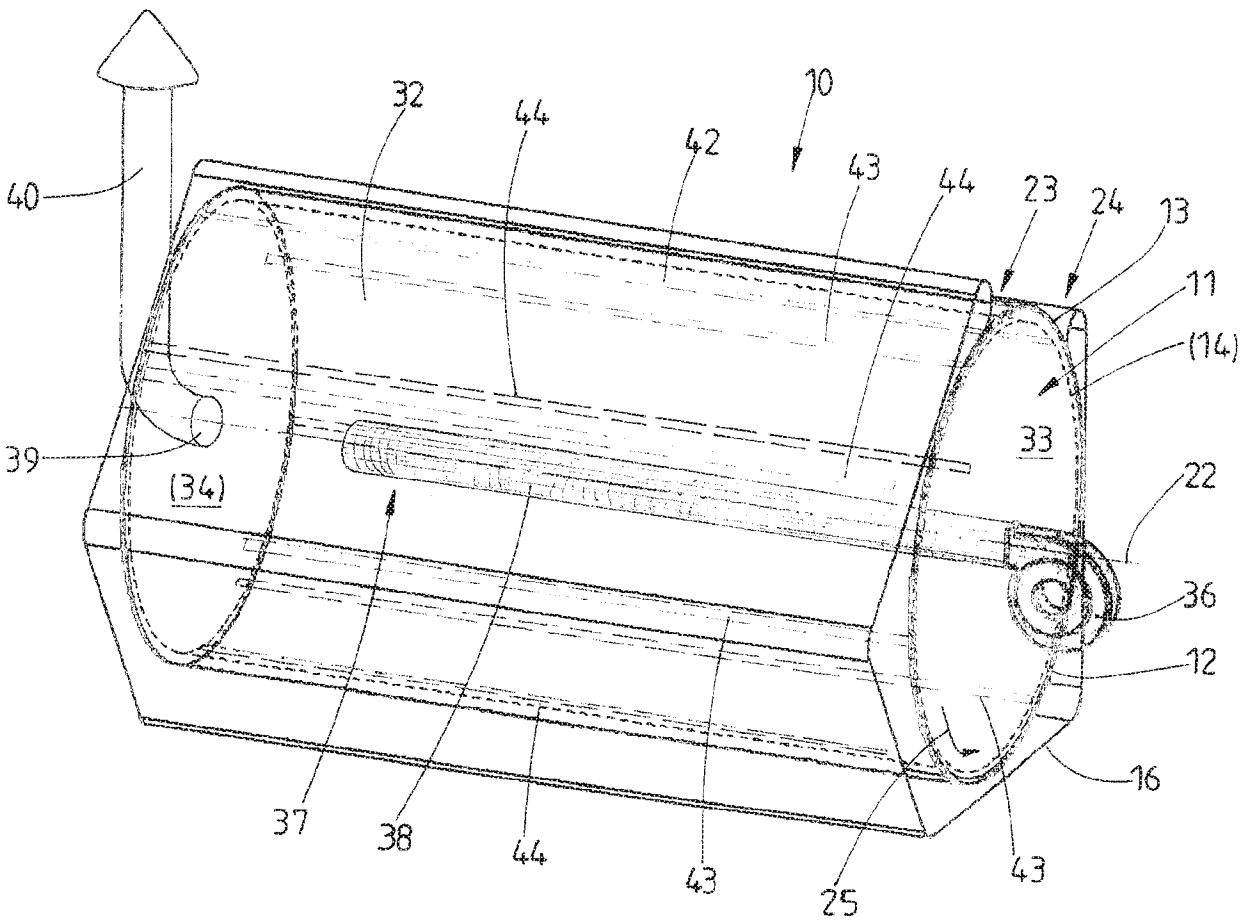
FIG. 2 shows a perspective schematic diagram of the device of FIG. 1.
Figure 3:
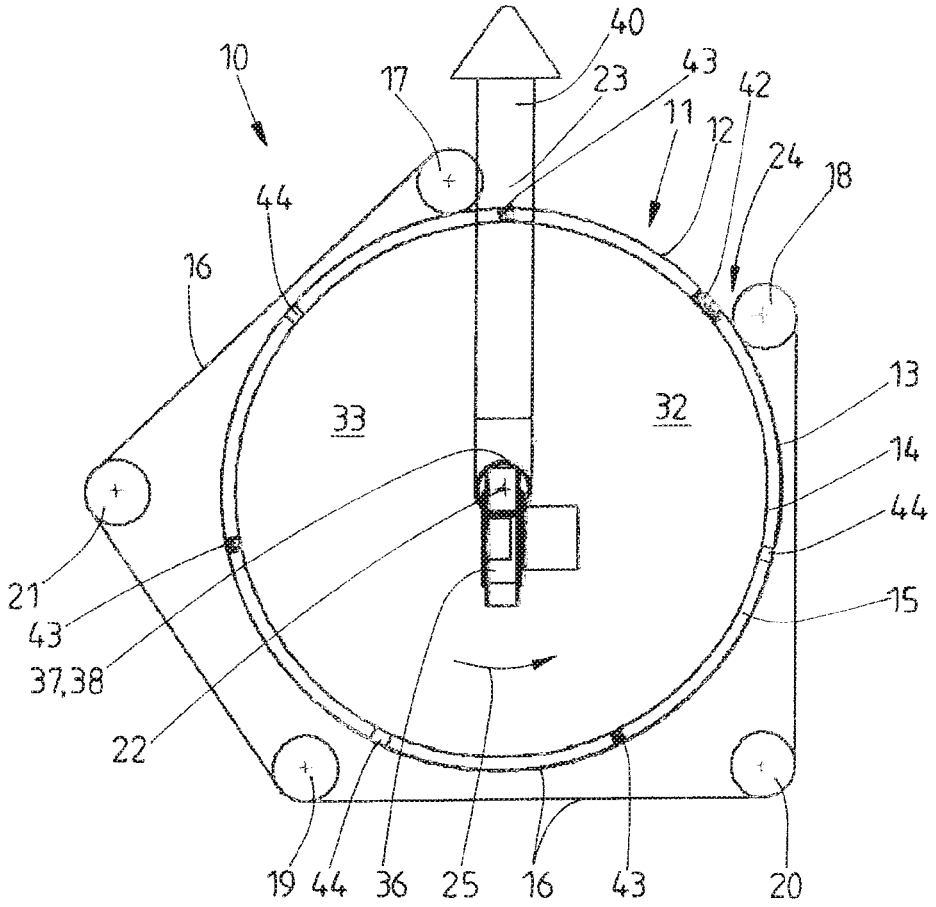
FIG. 3 shows a principle side view of the device of FIG. 1.

Belt mangle 10 of the exemplary embodiment of FIGS. 2 and 3 is formed to be of single-duct design. Entire inner space 35 of boiler 32 consequently has a single cylindrical heating chamber. As a result, entire mangle body 11, and thus also entire cylindrical pressing surface 12 of belt mangle 10, can be evenly heated up.

A separating web 42 and several guiding webs 43, 44 are arranged in cavity 15 of double-walled mangle body 11. Separating web 42 and guiding webs 43, 44 bridge the inner side of outer mangle body wall 13 and the inner side of inner mangle body wall 14 in that they are fastened between mangle body walls 13 and 14.

Separating web 42 runs continuously in a gas-tight manner between end walls 33 and 34 of mangle body 11 in boiler 32. As a result of this, separating web 42 separates a starting region of cavity 15, as seen in the circumferential direction of mangle body 11, from the end region thereof. Continuous separating web 42 is arranged in the lateral upper circumferential region, which is released from mangle belt 16, of mangle body 11 between deflection drums 17 and 18. In the exemplary embodiment shown, separating web 42 is located, as seen in transport direction 25 of laundry items through the mangling gap, close behind deflection drum 18 in run-out region 24 of belt mangle 10.

The starting region of cavity 15 is located behind separating web 42 as seen in direction of transport 25. In this starting region, the heat transfer medium, in particular thermal oil, is initially heated up, for example, conducted from the outside into cavity 15 of mangle body 11. For this purpose, at least one supply port for the heat transfer medium is assigned to the starting region of cavity 15. The end region of cavity 15 is located in front of separating web 42 as seen in direction of transport 25. Here, cooled heat transfer medium is preferably conducted out of cavity 15 through at least one discharge port, not shown. The at least one discharge port leads via a corresponding line to at least one pump which pumps heat transfer medium via a supply line to the starting region of cavity 15 in double-walled mangle body 11. This pump generates a circulation of the heat transfer medium in cavity 15 so that it can flow through cavity 15.

Guiding webs 43 extend from end wall 33 of mangle body 11 up to shortly in front of opposite end wall 34 of mangle body 11. In contrast, guiding webs 44 extend from end wall 34 up to shortly in front of end wall 33. A guiding web 44 follows on in each case from a guiding web 43 in the circumferential direction of mangle body 11 in a regularly alternating manner. As a result of this, a continuous flow duct, which runs in a wavy line-like manner, is created in cavity 15 of double-walled mangle body 11 which begins, as seen in direction of transport 25, behind continuous separating web 42 and ends in front of continuous separating web 42. Guiding webs 43, 44 thus lead to a wavy line-like flow of the liquid heat transfer medium through cavity 15, and indeed in changing, opposite directions parallel to longitudinal center axis 22 of mangle body 11. A reversal of the direction of flow of the heat transfer medium in cavity 15 of double-walled mangle body 11 takes place where guiding webs 43 and 44 end at a distance in front of end wall 33 or 34. In the exemplary embodiment shown, three guiding webs 43 and guiding webs 44 are arranged in an alternating manner consecutively in cavity 15. Where necessary, the number of guiding webs can, however, be larger or smaller.

Figure 4:
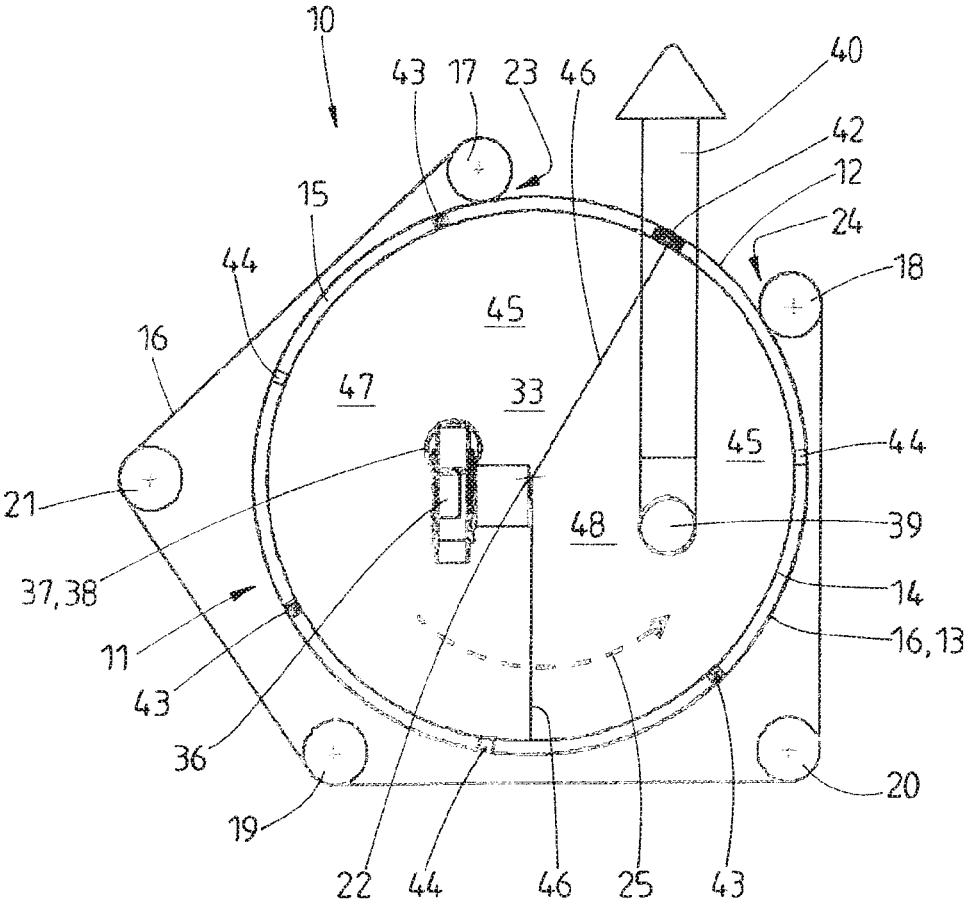
FIG. 4 shows a side view of a device analogous to FIG. 3 according to a second exemplary embodiment of the invention.

FIG. 4 shows a second exemplary embodiment of belt mangle 10 which only differs from the previously described exemplary embodiment in that boiler 45 is formed to have two ducts in the interior of double-walled mangle body 11. For this purpose, boiler 45 is divided by a separating wall 46 into two heating chambers 47 and 48 which are separate from one another. Heating chambers 47, 48 are formed to communicate with one another in terms of flow by means of at least one overflow duct, not shown in the figures, in separating wall 46. In the exemplary embodiment shown, separating wall 46 is angled, and indeed by a bend on longitudinal center axis 22 of mangle body 11. The bend is such that heating chamber 47 is slightly larger than heating chamber 48. In the exemplary embodiment shown, larger heating chamber 47 extends over a circumferential region of approximately 200° to 220° of mangle body 11. A lower flat portion of separating wall 46 runs from longitudinal center axis 22 radially perpendicularly downward, while the other upper portion of separating wall 46 runs from longitudinal center axis 22 radially to the region between deflection drums 17 and 18 of mangle body 11.

The separating wall runs continuously between opposing end walls 33, 34 of mangle body 11 or of boiler 32 and is connected in a gas-tight manner hereto. Longitudinal edges of separating wall 46 running parallel to longitudinal center axis 22 are connected to the inner side of inner mangle body wall 14 in a gas-tight manner.

The obliquely upward running portion of separating wall 46 ends where separating web 42, which is also present in this exemplary embodiment, in cavity 15 of double-walled mangle body 11, i.e. between run-in region 23 and run-out region 24. As a result, the starting region of cavity 15 in double-walled mangle body 11 lies at the start of larger heating chamber 47 as seen in direction of transport 25, while the end region of cavity 15 lies at the end of smaller heating chamber 48. Guiding webs 43 and 44 are furthermore provided in cavity 15 as in the case of the exemplary embodiment of FIGS. 1 to 3. As a result of this, a continuous wavy line-like flow duct for the heat transfer medium, in particular thermal oil, is also created in cavity 15 of mangle body 11 of FIG. 4.

In the exemplary embodiment of FIG. 4, the heating device is arranged eccentrically in mangle body 11, namely with a parallel spacing to longitudinal center axis 22 in larger heating chamber 47. Burner 36 is consequently fastened eccentrically outside heating body 37 to end wall 33 of mangle body 11. The longitudinal center axis of tube- or hose-shaped incandescent mantle 38 of heating body 37 preferably formed as a radiant heater is also located with parallel spacing next to longitudinal center axis 22 of mangle body 11 in larger heating chamber 47. The liquid heat transfer medium conducted, as seen in direction of transport 25, behind separating web 42 into cavity 15, which surrounds larger heating chamber 47, is heated up in the region of larger heating chamber 47 by the gas heated up by heating body 37 in said larger heating chamber 47. As a result, the greater amount of thermal energy is available in larger heating chamber 47, where laundry to be flattened is transported from run-in region 43 along a larger part of pressing surface 12 of circumferential mangle belt 16.

No heating device is located in smaller subsequent heating chamber 48. The rear part of pressing surface 12 is heated up from heating chamber 48 by partially cooled hot air which flows through at least one corresponding opening through the lower, perpendicular portion of separating wall 46 into heating chamber 48. The air which is cooled further in heating chamber 48 passes with the flue gas from burner 36 through discharge opening 39 in end wall 34 of mangle body 11 from smaller heating chamber 48, and indeed preferably in turn in or through chimney 40.

In the case of belt mangle 10 shown in FIG. 4, cavity 15 for the heat transfer medium is not divided like boiler 32, rather the heat transfer medium, which is supplied at the start of larger heating chamber 47 behind separating web 42, is conducted at the end of rear smaller heating chamber 48 in front of separating web 42 out of cavity 15 in order to be introduced again by a pump in front of separating web 42 into cavity 15 of double-walled mangle body 11. As a result of this, a circuit of the liquid heat transfer medium is generated in cavity 15.

Figure 5:
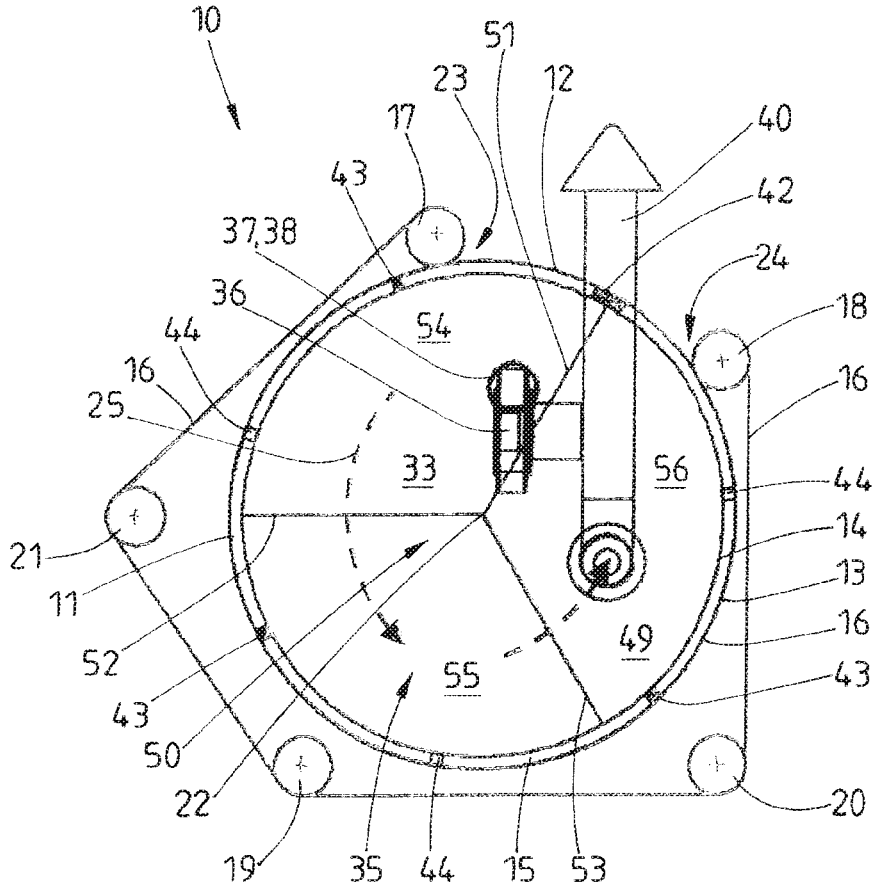
FIG. 5 shows a side view of a device analogous to FIG. 3 according to a third exemplary embodiment of the invention.

FIG. 5 shows a further exemplary embodiment of belt mangle 10 which differs from the previously explained exemplary embodiments of belt mangle 10 only by a three-duct boiler 49 in the interior of mangle body 11. To this end, boiler 49 is divided by a star-type separating wall 50 with three radial separating surfaces 51, 52 and 53 into three gas-tight and pressure-stable heating chambers 54, 55 and 56 which are of equal size in the exemplary embodiment shown. The three flat separating surfaces 51, 52 and 53 of equal size for formation of separating wall 50 jointly meet on longitudinal center axis 22 of mangle body 11. The three separating surfaces 51, 52 and 53 run from there radially to the inner surface of inner mangle body wall 14, to which they are connected. An outer longitudinal edge of separating surface 51 at the start of first heating chamber 54 in turn meets separating web 42 in cavity 15 of double-walled mangle body 11. This point lies in turn between run-in region 23 and run-out region 24 of belt mangle 10. Second separating surface 52, which is offset in direction of transport 25 by 120° with respect to separating surface 51, separates first heating chamber 54 from second heating chamber 55. Third separating surface 53 which is offset by a further 120° also separates second heating chamber 55 from third heating chamber 56. Separating surfaces 52 and 53 between first and second heating chamber 54, 55 as well as second and third heating chamber 55, 56 are in turn provided with in each case at least one passage opening for hot air or hot gas out of first heating chamber 54 into second heating chamber 55 or hot air or hot gas from second heating chamber 55 into third heating chamber 56.

In the case of three-duct belt mangle 10 of FIG. 5, the heating device is assigned in turn to first heating chamber 54, as is the case with two-duct belt mangle 10 of FIG. 4. Third and last heating chamber 56 has in turn a discharge opening 39 for cooled air from boiler 49. This is substantially cooled flue gas which, in the exemplary embodiment shown, is conducted from discharge opening 39 in turn to a chimney 40. The gas, which is already initially cooled in first heating chamber 54, is only conducted through central, second heating chamber 55 to third heating chamber 56. Treatment of the gas or air, and indeed neither heating up nor discharge, does not take place in heating chamber 55.

In the case of belt mangle 10 of the exemplary embodiment of FIG. 5, cavity 15 of double-walled mangle body 11 is likewise provided with a separating web 42 and several guiding webs 43 and 44, as is the case with the belt mangles of the previously described exemplary embodiments. Continuous separating web 42 is located at such a point in cavity 15 where it is met by the outer longitudinal edge of separating surface 51 between first heating chamber 54 and last heating chamber 56 of boiler 49. In the exemplary embodiment shown, the liquid heat transfer medium circulated in cavity 15 is consequently introduced, as seen in direction of transport 25 of laundry items through the mangling gap, at the start of first heating chamber 54, i.e. in front of run-in region 23, into cavity 15 and conducted out of cavity 15 at the end of third heating chamber 56, i.e. shortly behind run-out region 24. To this end, in the case of this exemplary embodiment, the liquid heat transfer medium is also circulated by means of at least one pump outside cavity 15, wherein the pump serves to generate the flow of the heat transfer medium through cavity 15.

The above exemplary embodiments relate to belt mangles 10 with in each case one cylindrical mangle body 11. The invention is, however, also suitable for belt mangles with mangle bodies of a different formation in cross-section, for example, elliptical or oval mangle bodies.

The above exemplary embodiments show belt mangles 10 with a single mangle body 11. The invention is, however, also suitable for belt mangles with several consecutive mangle bodies, wherein a separate mangling belt can be assigned to each mangle body, but only a single mangling belt can be assigned to all consecutive mangle bodies. Even in the case of belt mangles with several consecutive mangle bodies, these can have any desired cross-sections, therefore do not necessarily have to be cylindrical as represented in the figures. It is also conceivable in the case of belt mangles with several consecutive mangle bodies to configure the mangling bodies differently, in particular provide them in different sizes and/or with different cross-sections.

LIST OF REFERENCE NUMBERS

10 Belt mangle
11 Mangle body
12 Pressing surface
13 Outer mangle body wall
14 Inner mangle body wall
15 Cavity
16 Mangling belt
17 Deflection drum
18 Deflection drum
19 Deflection drum
20 Deflection drum
21 Deflection drum
22 Longitudinal center axis
23 Run-in region
24 Run-out region
25 Direction of transport
26 Run-in aid
27 Run-out aid
28 Input machine
29 Folding machine
30 Supply conveyor
31 Run-in conveyor
32 Boiler
33 End wall
34 End wall
35 Inner space
36 Burner
37 Heating body
38 Incandescent mantle
39 Discharge opening
40 Chimney
41 Blower
42 Separating web
43 Guiding web
44 Guiding web
45 Boiler
46 Separating wall
47 Heating chamber
48 Heating chamber
49 Boiler
50 Separating wall
51 Separating surface
52 Separating surface
53 Separating surface
54 Heating chamber
55 Heating chamber
56 Heating chamber

What is claimed is:

1. A device for mangling laundry items, comprising:

at least one stationary mangle body (11), the outer shell surface of which forms a heatable pressing surface (12); and at least one circumferentially drivable mangling belt (16) assigned to the at least one mangle body (11), by which mangling belt (16) the laundry items can be moved along on the outer pressing surface (12) of the at least one mangle body (11), wherein the at least one mangle body (11) has an interior and is formed to be double-walled with at least one cavity (15) between the walls, a heat transfer medium is located in the at least one cavity (15), and/or at least one heating device for heating the heat transfer medium in the cavity (15) is arranged entirely or at least partially in the interior of the at least one mangle body (11).

2. The device as claimed in claim 1, wherein the interior of the at least one mangle body (11) is formed as at least one boiler (32; 45; 49).

3. The device as claimed in claim 1, wherein the interior of the at least one mangle body (11) is formed or terminated to be at least partially gas- or pressure-tight and/or pressure-resistant.

4. The device as claimed in claim 2, further comprising at least one heating body (37) which forms at least a part of the heating device arranged in the interior of the at least one mangle body (11).

5. The device as claimed in claim 4, wherein the at least one heating body (37) is an infrared heating body.

6. The device as claimed in claim 2, further comprising at least one burner (36) which forms the heating device or a part thereof arranged in contours of the at least one mangle body (11) and outside the at least one boiler (32; 45; 49).

7. The device as claimed in claim 2, wherein a boiler area of the at least one boiler (32; 45; 49) and/or of the interior, which is formed in a gas- or pressure-tight and/or pressure-resistant manner, of the at least one mangle body (11) has several separate heating chambers (47, 48; 54, 55, 56).

8. The device as claimed in claim 7, wherein the heating chambers (47, 48; 54, 55, 56) are formed by at least one gas-tight or pressure-tight and/or pressure-resistant separating wall (46; 50) in the at least one boiler (45; 49) and/or in the interior of the at least one mangle body (11).

9. The device as claimed in claim 7, wherein the heating chambers (47, 48; 54, 55, 56) are connected by overflow ducts so that heated gas and/or flue gas gradually flow(s) through the heating chambers (47, 48; 54, 55, 56).

10. The device as claimed in claim 7, wherein a discharge opening (39) for cooled gas and/or also flue gas is assigned to a last of the heating chambers (48; 56).

11. The device as claimed in claim 1, further comprising at least one continuous, gas-tight separating web (42) arranged in the cavity (15) of the double-walled shell of the at least one mangle body (11) for separation of a starting region of the cavity (15) from the end region thereof.

12. The device as claimed in claim 1, further comprising guiding webs (43, 44) arranged in at least one cavity (15) of the at least one double-walled mangle body (11) for the formation of at least one wavy line-like flow duct for the heat transfer medium in the cavity (15) of the double-walled shell of the at least one mangle body (11).

13. The device as claimed in claim 1, wherein several separate cavities are formed in the double-walled shell of the at least one mangle body (11).

14. The device as claimed in claim 7, wherein a separate cavity in the double-walled shell surface of the at least one mangle body (11) is assigned to each heating chamber (47, 48; 54, 55, 56) in the interior of the at least one mangle body (11).

15. The device as claimed in claim 4, wherein the at least one heating body (37) is a radiant heater.

16. The device as claimed in claim 4, wherein the at least one heating body (37) is arranged in the boiler (32; 45; 49) and/or in the part, which is formed in a gas- or pressure-tight and/or pressure-resistant manner, of the interior of the at least one mangle body (11).

17. The device as claimed in claim 3, further comprising at least one heating body (37) which forms at least a part of the heating device arranged in the interior of the at least one mangle body (11).

18. The device as claimed in claim 17, wherein the at least one heating body (37) is a radiant heater.

19. The device as claimed in claim 17, wherein the interior of the at least one mangle body (11) is further formed as at least one boiler (32; 45; 49), and wherein the at least one heating body (37) is arranged in the boiler (32; 45; 49) and/or in the part, which is formed in a gas- or pressure-tight and/or pressure-resistant manner.

20. The device as claimed in claim 2, wherein a boiler area of the at least one boiler (32; 45; 49) and/or of the interior, which is formed in a gas- or pressure-tight and/or pressure-resistant manner, of the at least one mangle body (11) has several separate heating chambers (47, 48; 54, 55, 56), wherein the at least one heating body (37) or radiant heater is assigned only to a first heating chamber (47; 54) of the several separate heating chambers (47, 48; 54, 55, 56).

* * * * *